US009214052B2

(12) United States Patent
Knee et al.

(10) Patent No.: US 9,214,052 B2
(45) Date of Patent: Dec. 15, 2015

(54) ANALYSIS OF STEREOSCOPIC IMAGES

(75) Inventors: Michael James Knee, Hampshire (GB); Martin Weston, Hampshire (GB)

(73) Assignee: Snell Limited, Lower Earley, Reading (GB)

( * ) Notice: Subject to any disclaimer, the term of this patent is extended or adjusted under 35 U.S.C. 154(b) by 251 days.

(21) Appl. No.: 13/051,700

(22) Filed: Mar. 18, 2011

(65) Prior Publication Data

US 2011/0229014 A1 Sep. 22, 2011

(30) Foreign Application Priority Data

Mar. 18, 2010 (GB) ..... 1004539.1

(51) Int. Cl.
*G07F 9/10* (2006.01)

(52) U.S. Cl.
CPC ..... *G07F 9/10* (2013.01)

(58) Field of Classification Search
None
See application file for complete search history.

(56) References Cited

U.S. PATENT DOCUMENTS 5,574,836 A * 11/1996 Broemmelsiek ..... 345/427
6,215,899 B1 * 4/2001 Morimura et al. ..... 382/154
6,268,881 B1 * 7/2001 Muramoto ..... 348/55
2009/0207238 A1 * 8/2009 Kim et al. ..... 348/51
2010/0060720 A1 * 3/2010 Hirasawa ..... 348/49
2011/0025825 A1 * 2/2011 McNamer et al. ..... 382/154

FOREIGN PATENT DOCUMENTS

JP 8-237688 A 9/1996

OTHER PUBLICATIONS

Intellectual Property Office Search Report mailed May 17, 2010, issued in corresponding Application No. GB1004539.1, filed Mar. 18, 2010.

* cited by examiner

*Primary Examiner* — Amir Alavi
*Assistant Examiner* — Kenny Cese
(74) *Attorney, Agent, or Firm* — Christensen O'Connor Johnson Kindness PLLC

(57) ABSTRACT

A method of identifying the left-eye and the right-eye images of a stereoscopic pair, comprising the steps of comparing the images to locate an occluded region visible in only one of the images; detecting image edges; and identifying a right-eye image where image edges are aligned with a left hand edge of an occluded region and identifying a left-eye image where more image edges are aligned with a right hand edge of an occluded region.

3 Claims, 3 Drawing Sheets

ANALYSIS OF STEREOSCOPIC IMAGES

FIELD OF INVENTION

This invention concerns the analysis of stereoscopic images and in one example to the detection and correction of errors in stereoscopic images. It may be applied to stereoscopic motion-images.

BACKGROUND OF THE INVENTION

The presentation of 'three-dimensional' images by arranging for the viewer's left and right eyes to see different images of the same scene is well known. Such images are typically created by a 'stereoscopic' camera that comprises two cameras that view the scene from respective viewpoints that are horizontally spaced apart by a distance similar to that between the left and right eyes of a viewer.

This technique has been used for 'still' and 'moving' images. There is now great interest in using the electronic image acquisition, processing, storage and distribution techniques of high-definition television for stereoscopic motion-images.

Many ways of distributing stereoscopic image sequences have been proposed, one example is the use of separate image data streams or physical transport media for the left-eye and right-eye images. Another example is the 'side-by-side' representation of left-eye and right-eye images in a frame or raster originally intended for a single image. Other methods include dividing the pixels of an image into two, interleaved groups and allocating one group to the left-eye image and the other group to the right-eye image, for example alternate lines of pixels can be used for the two images.

To present the viewer with the correct illusion of depth, it is essential that his or her left eye sees the image from the left side viewpoint, and vice-versa. If the left-eye and right-eye images are transposed so that the left eye sees the view of the scene from the right and the right eye sees the view from the left, there is no realistic depth illusion and the viewer will feel discomfort. This is in marked contrast to the analogous case of stereophonic audio reproduction where transposition of the left and right audio channels produces a valid, equally-pleasing (but different) auditory experience.

The multiplicity of transmission formats for stereoscopic images leads to a significant probability of inadvertent transposition of the left and right images. The wholly unacceptable viewing experience that results from transposition gives rise to a need for a method of detecting, for a given 'stereo-pair' of images, which is the left-eye image, and which is the right-eye image. In this specification the term 'stereo polarity' will be used to denote the allocation of a stereo pair of images to the two image paths of a stereoscopic image processing or display system. If the stereo polarity is correct then the viewer's left and right eyes will be presented with the correct images for a valid illusion of depth.

In a stereo-pair of images depth is represented by the difference in horizontal position—the horizontal disparity—between the representation of a particular object in the two images of the pair. Objects intended to appear in the plane of the display device have no disparity; objects behind the display plane are moved to the left in the left image, and moved to the right in the right image; and, objects in front of the display plane are moved to the right in the left image, and moved to the left in the right image.

If it were known that all (or a majority of) portrayed objects were intended to be portrayed behind the display plane, then measurement of disparity would enable the left-eye and right-eye images to be identified: in the left-eye image objects would be further to the left than in the right-eye image; and, in the right-eye image objects would be further to the right than in the left-eye image.

However, it is common for objects to be portrayed either in front of or behind the display plane; and, a constant value may be added to, or subtracted from the disparity for a pair of images as part of the process of creating a stereoscopic motion-image sequence. For these reasons a simple measurement of horizontal disparity cannot be relied upon to identify left-eye and right-eye images of a stereo pair.

Attempts have been made to overcome this problem by making statistical assumptions about image portrayal, specifically that an object appearing lower in an image is assumed to be to the front of an object appearing higher in the image. Reference is directed in this context to U.S. Pat. No. 6,268,881 and US 2010/0060720. It will be understood that in many image pairs, such an assumption cannot be relied upon. For robust detection, it is desirable to reduce the reliance placed upon statistical assumptions.

SUMMARY OF THE INVENTION

The invention consists in a method and apparatus for analysing a pair of images intended for stereoscopic presentation to identify the left-eye and right-eye images.

Suitably, a first image of the pair is analysed to locate regions within it that are not visible in the second image of the pair.

Preferably, the step of analysing comprises detecting image edges and the step of identifying serves to identify a right-eye image where more image edges are aligned with a left hand edge of a said region and to identify a left-eye image where more image edges are aligned with a right hand edge of a said region.

Advantageously, the horizontal positions of the edges of the said regions of the first image are compared with the horizontal positions of portrayed edges in the first image.

In a preferred embodiment, the right hand edge of at least one of the said regions of the first image is located and the first image is identified as a left-eye image when the horizontal position of said right hand edge corresponds with the horizontal position of a portrayed edge in the first image.

Additionally or alternatively, the left hand edge of at least one of the said regions of the first image is located and the first image is identified as a right-eye image when the horizontal position of said left hand edge corresponds with the position of a portrayed edge in the first image.

In one embodiment, horizontal positions of the edges of the said regions of the first image are compared with positions of high pixel-value horizontal gradient in the first image.

Suitably, the said regions in the first image are identified by comparison of pixel values for respective groups of pixels in the said first and second images.

Additionally or alternatively, the said regions in the first image are identified by comparison of respective motion vectors derived for respective pixels in the said first and second images.

And, in the preferred embodiment, the product of an image horizontal gradient measure and an occlusion edge measure are summed over all or part of an image in order to determine a measure of stereo polarity for an image.

In another aspect, the present invention consists in apparatus for analysing a pair of images intended for stereoscopic presentation to identify the left-eye and right-eye images, comprising an occlusion detector adapted to locate one or more occluded regions visible in only one of the images; an occlusion edge processor; a horizontal gradient detector and a stereo polarity processor adapted to derive a stereo polarity flag from the outputs of the occlusion edge processor and the horizontal gradient detector.

The occlusion edge processor may be adapted separately to identify:

- image elements which are horizontally close to left hand edges of an occluded region; and
- image elements which are horizontally close to right hand edges of an occluded region.

The stereo polarity processor may be adapted to derive:

- a right stereo flag where relatively large numbers of picture elements have relatively large horizontal gradients and are horizontally close to a left hand edge of an occluded region; and
- a left stereo flag where relatively large numbers of picture elements have relatively large horizontal gradients and are horizontally close to a right hand edge of an occluded region.

In another aspect, the present invention consists in a method of identifying the left-eye and the right-eye images of a pair of images intended for stereoscopic presentation, comprising the steps of comparing the images of a stereoscopic pair to locate a region or regions visible in only one of the images; detecting image edges; and identifying a right-eye image where more image edges are aligned with a left hand edge of a said region than are aligned with a right hand edge of a said region and to identify a left-eye image where more image edges are aligned with a right hand edge of a said region than are aligned with a left hand edge of a said region.

BRIEF DESCRIPTION OF THE DRAWINGS

An example of the invention will now be described with reference to the drawings in which.

DETAILED DESCRIPTION OF THE INVENTION

Figure 1:
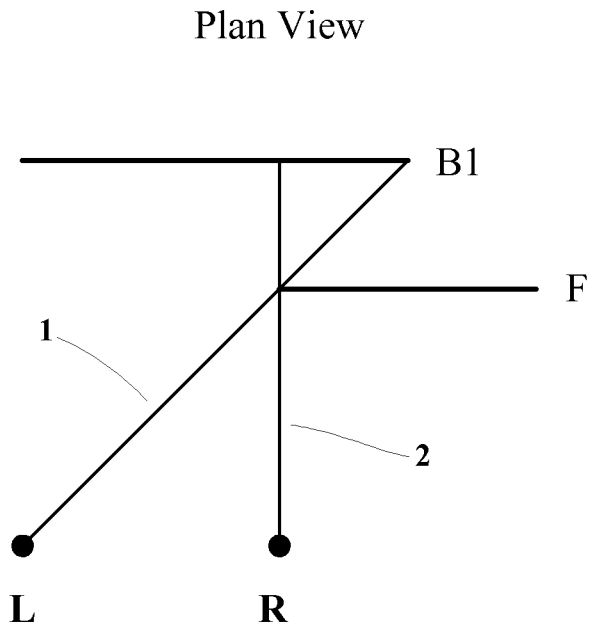
FIG. 1 shows a plan view of a scene showing two objects and two horizontally-separated viewpoints.

In the description that follows it is assumed that images are represented and processed as data for arrays of pixels, however the skilled person will appreciate that the methods of the invention can be implemented using other image formats, including formats that are not spatially sampled or digitised.

One clear and measurable difference between the left-eye and right-eye views of a three dimensional scene is that each view has some 'background' pixels not present in the other view. The left eye sees more background pixels to the left of 'foreground' objects and the right eye sees more background pixels to the right of foreground objects. Such 'occlusions' can be identified by comparing the two views. In this specification image regions that are present in a first image of a stereo pair, but not present in the second image of the pair, will be described as occluded regions of the first image. Occlusion is thus a property of a region in a first image that depends on the content of a second image.

There are many known image comparison techniques, the methods used in finding 'motion vectors' for use in 'motion-compensated' image processes are particularly useful for finding occluded areas. The term 'motion vector' will be used in this specification to refer to a vector that describes the difference in position of a portrayed object in the two images of a stereo pair. The image comparison methods used to determine the difference in position due to motion between two images taken at different times are equally applicable to the case of determining stereoscopic disparity. Typically a region in a first image is compared with a region having the same size and shape in a second image; the result is a 'displaced-frame-difference measure' or DFD. The location of the region in the second image relative to the region in the first image can be chosen according to a 'candidate' motion vector derived from an image correlation process; or, a number of regions in the second image can be selected for comparison according to a suitable search strategy.

There are many ways of calculating DFDs, typically pixel-value differences are summed; spatial filtering of differences may be used to give greater weight to pixels near to the centres of the region being matched. A low-value DFD will be associated with a pair of regions that are well-matched. In motion estimation, the vector indicating the location of a region in a second image with a low DFD relative to a region in a first image is assumed to be a good motion vector for one or more pixels of the first image region.

In an image selected from a stereo pair of images, occluded image regions are characterised by high-value DFDs relative to the other image of the pair; these occluded regions will not generally match any regions in the other image. Thus DFDs for each pixel of an image can be evaluated and compared with a threshold, and pixels categorised as occluded when the respective DFD exceeds that threshold.

Another way of detecting occluded regions is to make use of the fact that valid motion vectors cannot be derived for occluded regions. In order to find occluded regions in an image, motion vectors are evaluated from the left-eye image to the right-eye image, and also from the right-eye image to the left-eye image. These vectors are allocated to respective pixels as in the known methods of motion-compensated video processing. For example block-based motion vectors derived from a phase-correlation process can be allocated to pixels of an image by choosing the vector that gives the lowest DFD when a region centred on a particular pixel is shifted by the candidate vector and compared with the other image of the stereo pair.

A vector-derived occlusion measure for a pixel in a first image of the pair is obtained by 'following' the motion vector for that pixel to a pixel in the second image of the pair, and then 'returning' to the first image according to the motion vector for the second image pixel. The distance between the point of return and the location of the first image pixel is an occlusion measure for the first image pixel. This can be expressed mathematically as follows:

Let: $V[x_A,y_A]$ be the motion vector from image A to image B for the pixel in image A at co-ordinates $[x_A,y_A]$, having respective horizontal and vertical components $V_x[x_A,y_A]$ and $V_y[x_A,y_A]$; and, $W[x,y]$ be the motion vector from image B to image A for the pixel in image B at co-ordinates $[x,y]$;

Then:

$$Occ_A[x_A,y_A]=|V[x_A,y_A]-W[(x_A+V_x[x_A,y_A]),(y_A+V_y[x_A,y_A])]|$$

Where: $Occ_A[x_A,y_A]$ is the occlusion measure for the pixel in image A at co-ordinates $[x_A,y_A]$; and, $|X|$ is the magnitude of the vector X.

As occlusions due to differences in the horizontal position of the viewpoint are particularly relevant to stereoscopy, it is preferred to take the magnitude of the horizontal component of the motion vector difference as the occlusion measure, rather than the magnitude as shown in the above equation. The measure for each pixel can be compared with a threshold, and pixels identified as occluded pixels when the threshold is exceeded.

In stereoscopic images edge features resulting from transitions between objects at different depths in the scene, for example between foreground and background objects contain information about stereo polarity. In a method according to one aspect of the invention the positions of vertical edges in an image are compared with the positions of the vertical edges of the occluded areas of that image. FIGS. 1 to 4 show how this comparison enables left-eye and right-eye images to be identified.

Referring to FIG. 1, two flat, rectangular objects F and B1 are viewed from two viewpoints L and R. The object F is closer to the viewpoints than the object B1. The object F horizontally overlaps the right hand edge of B1 such that the whole of B1 is visible from L, but only the left hand part of B1 is visible from R. The respective visible areas of B1 are limited by the respective sightlines from L and R through the left hand edge of F; these are the lines (1) and (2) in the Figure.

Figure 2:
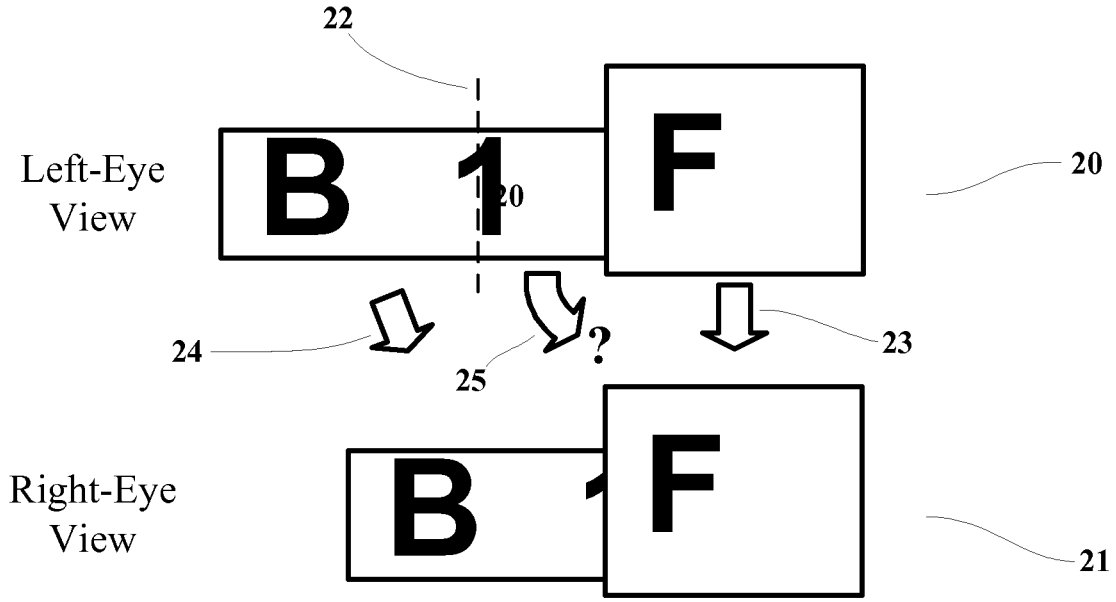
FIG. 2 shows the relationship between the views seen from the viewpoints in FIG. 1.

The respective views as would be seen by cameras positioned at L and R are shown in FIG. 2. The view from L (20) shows the whole areas of both objects. The view from R (21) shows the whole of F, but only the left hand part of B1. The portion of B1 to the right of the line (22) is thus an occluded area.

If the two views were analysed using the above-described methods for detecting occlusions, the pixels representing F would be found to match in both images giving low DFDs and-or low motion vector differences. This is indicated by the arrow (23).

Similarly the pixels representing the left hand portion of B1 would be found to match and have a low motion vector difference. (Although the motion vectors would be different from the motion vectors for F.) This is indicated by the arrow (24).

However the pixels, in the view from L (20), representing the right hand side of B1 do not reliably match pixels in the view from R. These pixels would have high DFDs and attempts to generate motion vectors for them would give highly erratic results. This is indicated by the arrow (25).

Thus, in the image comprising the view from L (20), the area of B1 to the right of the line (22) can be detected as an occluded area. This area is bounded on the left by part of the line (22), which is a notional construct unrelated to the image itself; and, it is bounded on the right by the edge between B1 and F, which is a feature of the image.

Figure 3:
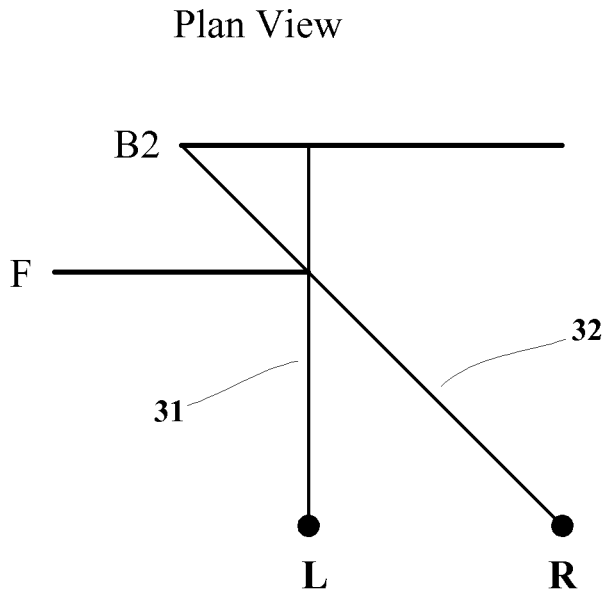
FIG. 3 shows a plan view of an alternative scene showing two objects and two horizontally-separated viewpoints.
Figure 4:
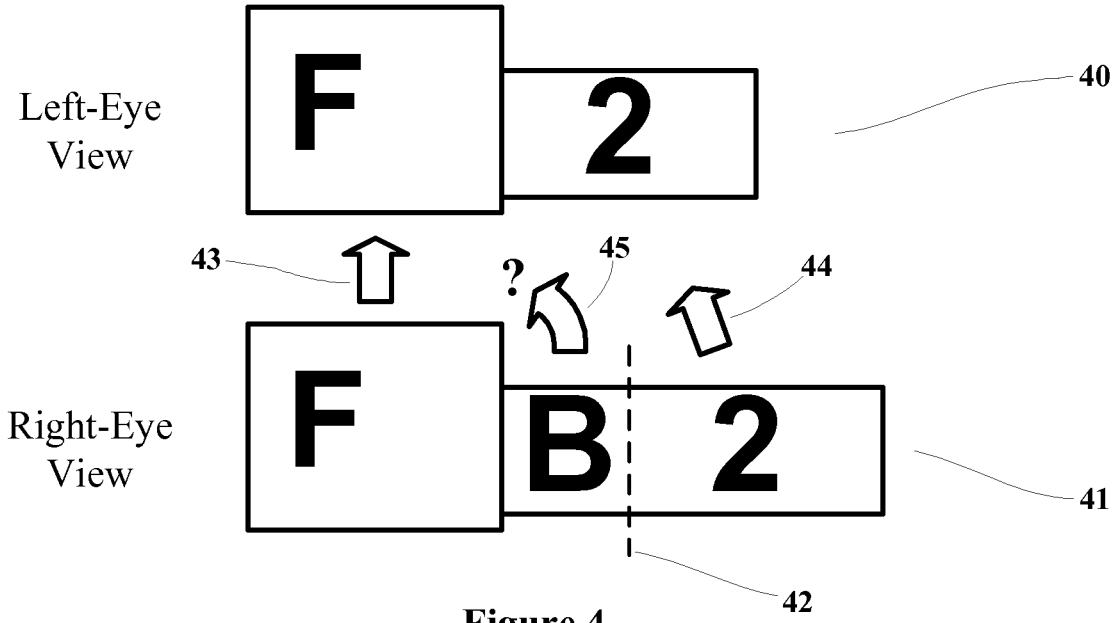
FIG. 4 shows the relationship between the views seen from the viewpoints in FIG. 3.

FIGS. 3 and 4 show an analogous arrangement where the object F horizontally overlaps the left hand edge of a more distant object B2, such that the whole of B2 is visible from R, but only the right hand part of B1 is visible from L. Here, analysis of the image comprising the view from R (41) will identify an occluded area bounded on the left by the edge between F and B2, which is an image feature; and, bounded on the right by part of the line (42) which is a notional construct unrelated to the image itself.

It can thus be seen that a left-eye image will tend to include image edges that align with the right edges of its occluded areas; and, a right-eye image will tend to include image edges that align with the left edges of its occluded areas.

Figure 5:
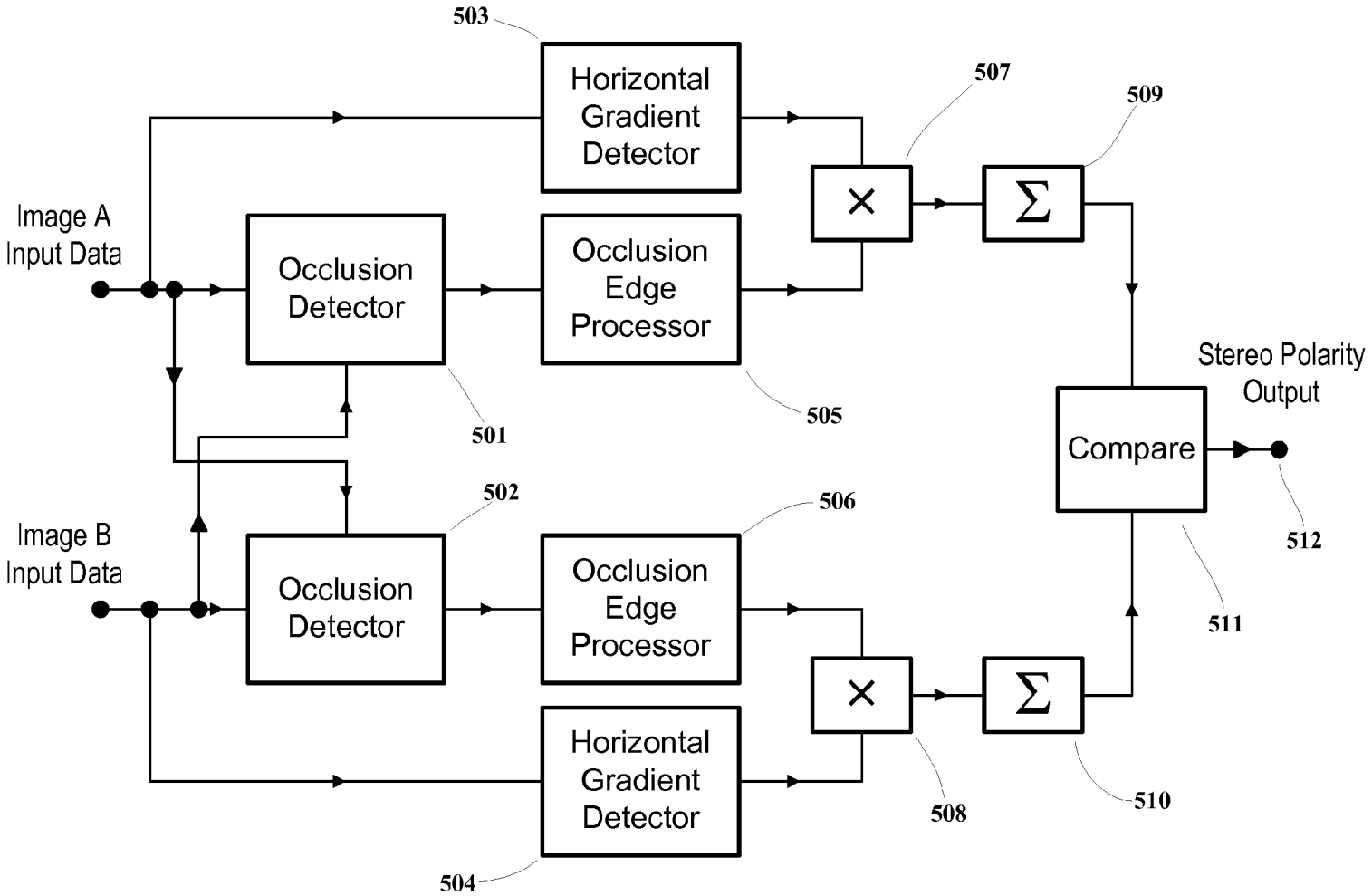
FIG. 5 shows a block diagram of an image analysis process according to an embodiment of the invention.

A block diagram of a process that uses this principle to ascertain the 'stereo polarity' of a pair of images A and B is shown in FIG. 5. Referring to this Figure, input data representing image A and input data representing image B are compared to find their respective occluded areas in occlusion detectors (501) and (502). The occlusion detector (501) identifies pixels in image A that have no counterparts in image B; and, the occlusion detector (502) identifies pixels in image B that have no counterparts in image A. These detectors can, for example, use either the DFD-based or motion vector-based method described above.

The input image data for images A and B are also input to respective horizontal gradient detectors (503) and (504). These derive a horizontal gradient measure for each pixel of the respective input image. A suitable measure is given by:

$$\mathrm{Grad}_A[x,y]=|p[(x+1),y]-p[(x-1),y]|$$

Where:

$\mathrm{Grad}_A[x,y]$ is the horizontal gradient measure for the pixel of image A located at co-ordinates [x,y];

p[x,y] is the luminance value of the pixel located at co-ordinates [x,y]; and,

|x| is the magnitude of x.

The two sets of occluded pixel data from the occlusion detectors (501) and (502) are processed to create respective occlusion-edge data sets for image A and image B in respective occlusion edge processors (505) and (506). This data identifies pixels that are horizontally close to the edges of occluded regions; pixels close to left hand and right hand occlusion edges are separately identified. A suitable method is to find a signed, horizontal gradient measure for the respective occlusion measure, for example a difference between the occlusion measures for horizontally adjacent pixels. In the illustrated example the value for the pixel to the left of the current pixel is subtracted from the value of the current pixel. The result will have a positive value at the left hand edges of occlusions and a negative value at the right hand edges. This signal can be 'widened' by non-linearly combining it with delayed and advanced copies of itself. For positive signals this widening is a 'dilation' process; and, for negative signals this widening is an 'erosion' process.

The outputs of the occlusion edge processors (505) and (506) are thus positive for pixels horizontally close to the left hand edges of occlusions, and negative for pixels horizontally close to the right hand edges of occlusions. The two outputs are multiplied by the respective image horizontal gradient magnitude values in multipliers (507) and (508).

The output from the multiplier (507) has large positive values for pixels of image A having steep gradients (of either polarity) that lie close to the left hand edges of occlusions; and large negative values for pixels having steep gradients (of either polarity) that lie close to the right hand edges of occlusions. These values are summed for all the pixels of image A in a summation block (509). This value is likely to be large and positive if image A is a right-eye image; or, large and negative if image A is a left-eye image.

Similarly the output from the multiplier (508) is summed for all the pixels of image B in a summation block (510). The result of this summation is likely to be large and positive if image B is a right-eye image; or, large and negative if image B is a left-eye image.

The two summations are compared in a comparison block (511) to obtain a measure of the 'stereo polarity' of the pair of images A and B. If the output from the summation block (509) exceeds the output of the summation block (510) then the stereo polarity of images A and B is correct if image A is the right-eye image. The result of the comparison is output at terminal (512).

It is only possible to identify the left-eye and right-eye images when objects having different depths are portrayed. In a moving image sequence it will usually be helpful to combine analysis results from several images in the sequence; if the stereo polarity is unlikely to change very often, this temporal filtering can be used to increase the reliability of the detection at the expense of delaying the discovery of changes.

Hysteresis can also be used so that changes in the detected polarity are not reported until a significant change in the analysis result has been seen.

Some methods of distributing and storing stereoscopic motion-image sequences use left-eye and right-eye images that do not correspond to the same point in time. In this case additional disparity between the images of each stereo pair will be introduced by motion. This problem can be solved by comparing each image with two opposite-eye images, one temporally earlier and one temporally later. The motion-induced disparity will be in opposite directions in the two comparisons, whereas the depth-related disparity will be similar.

The edges of the image frame give rise to strong occlusions however these are sometimes deliberately modified as part of the creative process. Therefore it is often helpful to ignore occlusions at the edges of the frame when determining the stereo polarity.

There are a number of alternative implementations of the invention. Sub-sampled or filtered images may be used. The spatial resolution of the images that are analysed may be deliberately reduced in the vertical direction relative to the horizontal direction because of the lack of relevance of vertical disparity to the portrayal of depth.

The 'motion estimation' process between the two images may be purely horizontal, or the vertical components of motion vectors may be discarded.

The method of occlusion detection using DFDs may be combined with the vector-difference method so that a combination of a motion vector difference and a DFD for a pixel is used as an occlusion measure for that pixel.

In the correlation of the positions of image edges with occlusion edges, the image edge data may be dilated rather than dilating the occlusion edges as described above. Dilation/erosion of the occlusion edges by seven pixels has been found to work well, but other values may also be used.

The threshold used to detect occlusions need not be fixed, it may be derived from analysis of, or metadata describing, the images to be processed.

Pixel values other than luminance values can be used to locate edges or transitions in the images. A combination of luminance and chrominance information may better enable image transitions between object to be located.

Techniques other than multiplication and summing may be used to determine whether more image edges are aligned with a left hand edge of a said region than are aligned with a right hand edge of a said region or whether more image edges are aligned with a right hand edge of a said region than are aligned with a left hand edge of a said region.

The invention claimed is:

1. Apparatus for analysing a stereoscopic image sequence comprising a plurality of pairs of images, each pair comprising a left-eye image and a right-eye image, comprising:

an occlusion detector adapted to locate one or more occluded regions visible in one image of the pair of images and not visible in the other image of the pair of images;

an occlusion edge processor adapted separately to identify:

image elements which are horizontally close to left hand edges of an occluded region; and image elements which are horizontally close to right hand edges of an occluded region;

a horizontal gradient detector; and stereo polarity processor adapted to derive a stereo polarity flag from the outputs of the occlusion edge processor and the horizontal gradient detector;

in which the stereo polarity processor is adapted to derive:

i. a right stereo flag where relatively large numbers of picture elements have relatively large horizontal gradients and are horizontally close to a left hand edge of an occluded region; and ii. a left stereo flag where relatively large numbers of picture elements have relatively large horizontal gradients and are horizontally close to a right hand edge of an occluded region.

2. A method of processing in a processor a stereoscopic image sequence comprising a plurality of pairs of images, each pair comprising a left-eye image and a right-eye image, the method comprising the steps of:

locating one or more occluded regions visible in one image of the pair of images and not visible in the other image of the pair of images;

separately identifying:

i. image elements which are horizontally close to left hand edges of an occluded region; and ii. image elements which are horizontally close to right hand edges of an occluded region;

detecting a horizontal gradient; and deriving:

i. a right stereo flag where relatively large numbers of picture elements have relatively large horizontal gradients and are horizontally close to a left hand edge of an occluded region; and ii. a left stereo flag where relatively large numbers of picture elements have relatively large horizontal gradients and are horizontally close to a right hand edge of an occluded region.

3. A non-transitory computer readable storage medium comprising code adapted to, when executed, cause a programmable apparatus to process in a processor a stereoscopic image sequence comprising a plurality of pairs of images, each pair comprising a left-eye image and a right-eye image, by:

locating one or more occluded regions visible in one image of the pair of images and not visible in the other image of the pair of images;

separately identifying:

i. image elements which are horizontally close to left hand edges of an occluded region; and ii. image elements which are horizontally close to right hand edges of an occluded region;

detecting a horizontal gradient; and deriving:

i. a right stereo flag where relatively large numbers of picture elements have relatively large horizontal gradients and are horizontally close to a left hand edge of an occluded region; and ii. a left stereo flag where relatively large numbers of picture elements have relatively large horizontal gradients and are horizontally close to a right hand edge of an occluded region.

* * * * *